US005415379A

United States Patent [19]

Hoyt et al.

[11] Patent Number: 5,415,379

[45] Date of Patent: May 16, 1995

[54] PNEUMATIC WINCH

[76] Inventors: Reed W. Hoyt, 23 Willowbrook Rd., Framingham, Mass. 01701; John F. Lanza, 20 Third St., Natick, Mass. 01760

[21] Appl. No.: 33,391

[22] Filed: Mar. 19, 1993

[51] Int. Cl.[6] ..... B66F 1/00; B65H 20/24; F15B 15/22; F01B 9/00

[52] U.S. Cl. ..... 254/386; 91/400; 92/137; 226/115

[58] Field of Search ..... 254/386, 360, 384, 264; 91/399, 400, 401; 92/5 R, 137; 226/115, 118, 119

[56] References Cited

U.S. PATENT DOCUMENTS

| | | | |
|---|---|---|---|
| 3,675,899 | 7/1972 | McKendrick | 254/386 |
| 3,856,266 | 12/1974 | McKendrick | 254/386 |
| 4,057,257 | 11/1977 | Berg | 92/137 X |
| 4,455,013 | 6/1984 | Fischer et al. | 254/267 |
| 4,634,101 | 1/1987 | Lauber | 254/264 X |
| 4,712,772 | 12/1987 | Negrutsky et al. | 254/264 |
| 4,729,283 | 3/1988 | Hillier | 91/401 X |
| 4,839,591 | 6/1989 | Nomura et al. | 92/5 R X |
| 4,856,414 | 8/1989 | Churkin et al. | 92/137 X |
| 4,899,643 | 2/1990 | Hvilsted et al. | 92/5 R |

FOREIGN PATENT DOCUMENTS

| | | | |
|---|---|---|---|
| 77872 | 7/1954 | Denmark | 254/386 |
| 2949581 | 6/1981 | Germany | 254/386 |

*Primary Examiner*—Joseph J. Hail, III
*Assistant Examiner*—Michael R. Mansen
*Attorney, Agent, or Firm*—John F. Moran

[57] ABSTRACT

A winch includes a cylinder containing a movable piston to which are respectively mounted a fixed and a movable pulley assembly around which a line to be pulled is entrained. The pulley assemblies are located within the working chamber and the line enters the cylinder through one end formed remote from the chamber and through a one way brake mounted to that remote end. The brake permits line to enter the cylinder as the working chamber is pressurized to move the piston and thereby the movable assembly towards the remote end. The one way brake prevents line from exiting the cylinder at this location. The line extends slidingly through the piston and may exit the cylinder at the opposite end thereof which is also equipped with a one way brake which prevents line from entering the cylinder but allows the line to exit the cylinder. End of stroke positions of the piston are sensed by means of Hall Effect Sensors to control pressurization and venting of the working chamber through a three way valve.

25 Claims, 5 Drawing Sheets

PNEUMATIC WINCH

GOVERNMENT INTEREST

The invention described and claimed herein may be manufactured, licensed and used by or for Governmental purposes without the payment of any royalties to us thereon.

TECHNICAL FIELD

The present invention relates generally to devices for controlling the reeling in and paying out of a length of line and, more particularly, to a winch capable of retracting an unlimited length of line, or ascending a line with or without a load.

BACKGROUND ART

Winches are commonly used to lift a load with a line, wherein such winches of which we are aware may include an arrangement of pulleys around which the line is wrapped to provide a predetermined mechanical advantage ratio. The pulleys are moved towards and away from each other by means of a piston and cylinder arrangement. The interaction of such a piston and cylinder arrangement with the pulley assembly in known devices results in a complex and expensive to manufacture structure.

It is accordingly an object of the present invention to provide a pneumatic or hydraulic winch of a block and tackle type construction which has relatively few moving parts, is therefore simple in design, and capable of reliable operation in rugged and hostile environments.

Another object is to provide a pneumatic winch wherein the pulley assembly is located within a working area of a piston and cylinder arrangement to achieve a substantially even distribution of operating forces during operation of the winch which wall result in a stronger and safer device.

SUMMARY OF THE INVENTION

A winch for operating a line comprises a cylinder and a piston movable within the cylinder. A first pulley assembly is fixedly mounted to the cylinder and a second pulley assembly is mounted to the piston for movement therewith relative to the first pulley assembly. The line is alternately wound around the first and second pulley assemblies and extends outside of the cylinder. A first brake unit, connected to the cylinder and through which the line extends, permits line to enter the cylinder in the reverse direction during separation of the pulley assemblies in the working stroke of the piston but prevents the line from exiting the cylinder in the reverse direction during the return or exhaust piston stroke. A piston actuating arrangement reciprocates the piston in the cylinder to move the piston and the second pulley assembly in the working stroke to progressively haul the line into the cylinder during each working stroke of the piston.

The first and second pulley assemblies are preferably located in the working chamber. The fixed pulley assembly is attached to one end wall of the cylinder and the movable pulley assembly is fixed to the working face of the piston for movement therewith. A second brake unit fixed to the end wall supporting the fixed pulley assembly permits line to exit the cylinder through this end wall but not re-enter the cylinder. In the alternative, a takeup reel may be provided in proximity to the fixed pulley assembly, or outside the cylinder, to progressively store line which has been winched as a result of piston movement.

Pressurized fluid is supplied to the working chamber to move the piston in its expanded or working stroke. Preferably, the pressurized fluid source is connected to the working chamber through a three way valve which is responsive to signals supplied thereto through a pair of sensors located at opposite ends of the piston stroke. These sensors detect the presence of the piston and control the valve to introduce pressurized fluid into the working chamber at the beginning of the working stroke, or to exhaust pressurized fluid from the working chamber at the onset of the return stroke.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and that several details are capable of modifications in various obvious respects, all without departing from the invention. Accordingly, the drawing and description are to be regarded as illustrative in nature, and not as restrictive.

BEST MODE FOR CARRYING OUT THE INVENTION

Figure 1:
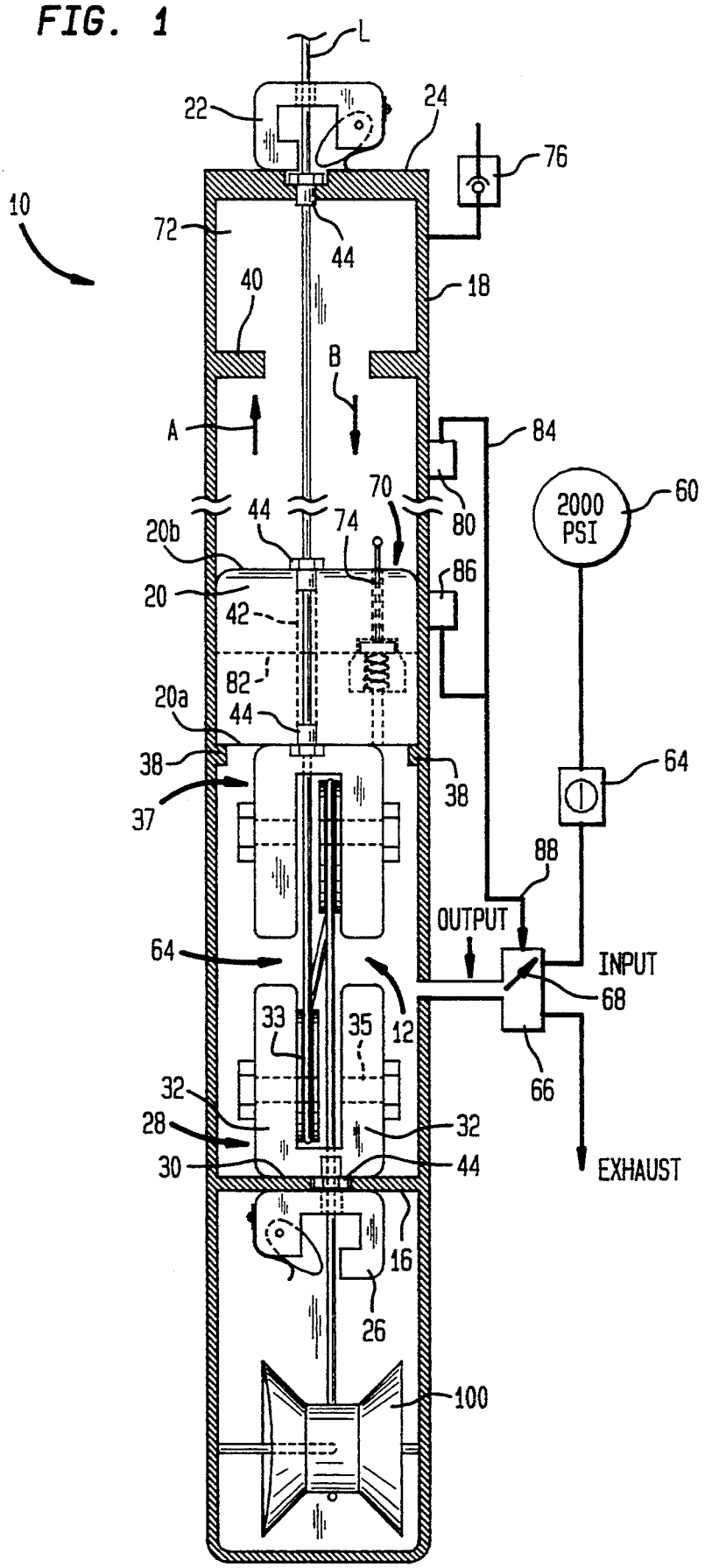
FIG. 1 is an illustration of a pneumatic winch, partly depicted in schematic view, of a preferred embodiment of the invention.
Figure 5:
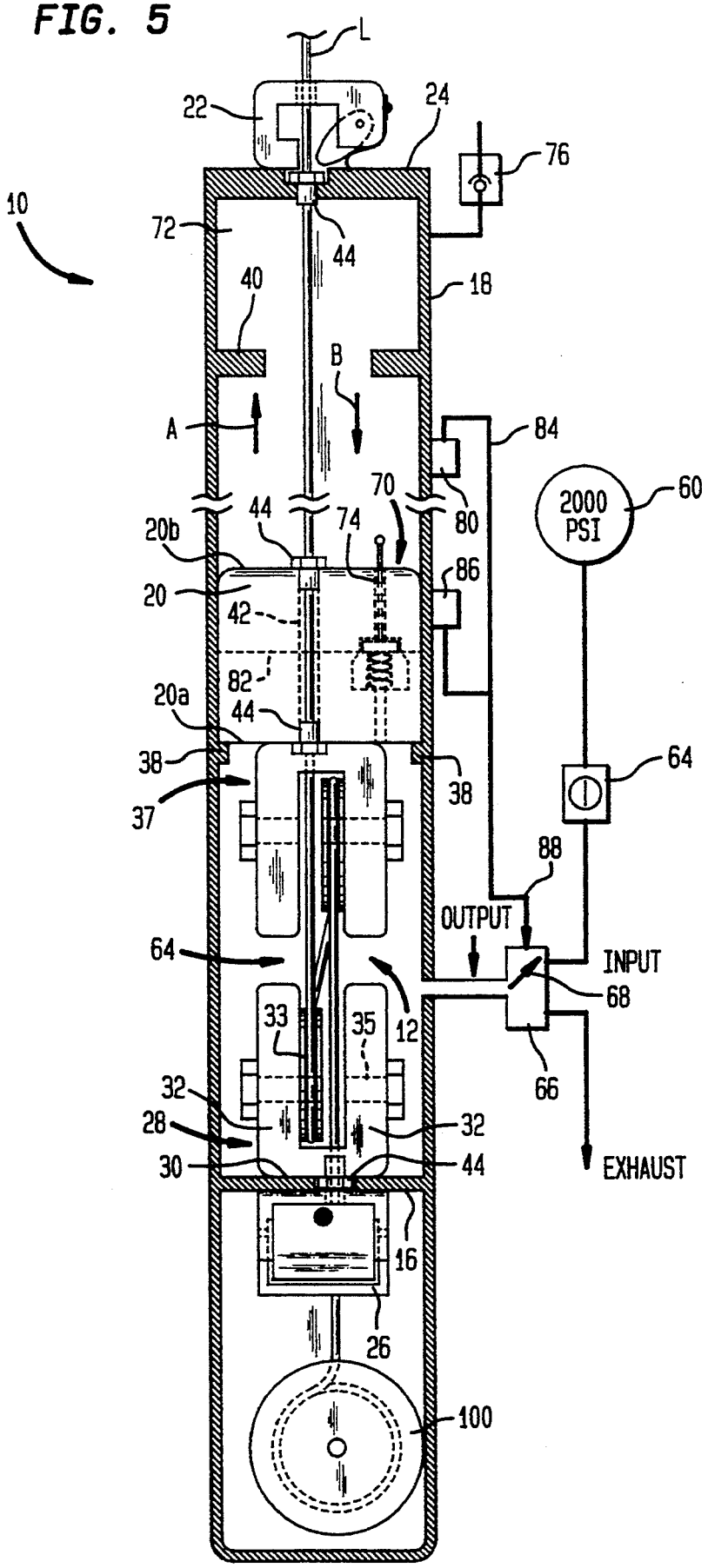
FIG. 5 is an schematic illustration of an alternate embodiment of the invention.

FIG. 1 is an illustration of a pneumatic winch 10 constructed in accordance with the present invention through which a line L extends for entrainment about a pulley arrangement generally designated with reference numeral 12. The pulley arrangement 12 is advantageously disposed within a working chamber 14 defined between one end wall 16 of a cylinder 18 and an end face 20*a* of a piston 20 movable in reciprocating strokes within the cylinder under the action of pressurized fluid admitted into the cylinder in the unique manner described below. The line L initially enters the cylinder 18 through a one way line brake 22 attached to the outer surface of the top end wall 24 of the cylinder for entrainment around pulley arrangement 12 as discussed in more detail below. The line L exits through a second one way line brake 26 mounted to the outer surface of the bottom end wall 16. The upper one way line brake 22 allows line L to enter the cylinder 18 through top end wall 24 (i.e., in the direction of arrow B) but does not allow the line to exit the top, i.e., movement in direction A is prevented. The lower one way line brake 26 at the bottom wall 16 allows the line L to exit (in the direction of arrow B) the cylinder 18 but does not allow the line to enter (direction A). Therefore, as the piston 20 is moved in its up or working stroke (away from bottom wall 16) in direction A, line L enters into the cylinder 18 through top end wall 24. As the piston 20 descends in its down or exhaust stroke (towards bottom end wall 16), direction B, the line L exits through the bottom end wall, preferably assisted either by a take-up reel 100 (see FIG. 5), or a mass M attached to the line below the winch 10 to facilitate line movement through the bottom one way line brake 26. In this manner, a load (not shown) attached to the upper portion of line L (i.e. before it enters cylinder 18 through top end wall 24) can be hoisted with winch 10 of this invention. In the alternative, winch 10 may be used as an ascender to lift and lower itself and a load (optional) along line L.

Pulley arrangement 12 comprises a fixed pulley assembly 28 which may include a mounting bracket having a base plate 30 fixed to the inner surface of bottom end wall 16, and a pair of parallel side arms 32 projecting upwardly from the bottom end wall towards piston 20. One or more pulleys 33 (only one shown in the illustrated embodiment) are mounted to a support shaft 35 extending between the arms 32. A substantially identical movable pulley assembly 37 is fixed to the working end face 20*a* of piston 20 for movement therewith in opposition to the fixed pulley assembly 28. In its lower or retracted position, depicted in FIGS. 1 and 3, piston 20 initially abuts a mechanical stop arrangement 38 secured to the inside surface of the cylinder 18 in radially outward spaced relation to the movable pulley assembly 37. The upward extent of piston movement is defined by a similar or identical pair of mechanical stops 40 located adjacent the top end wall 24.

Figure 4:
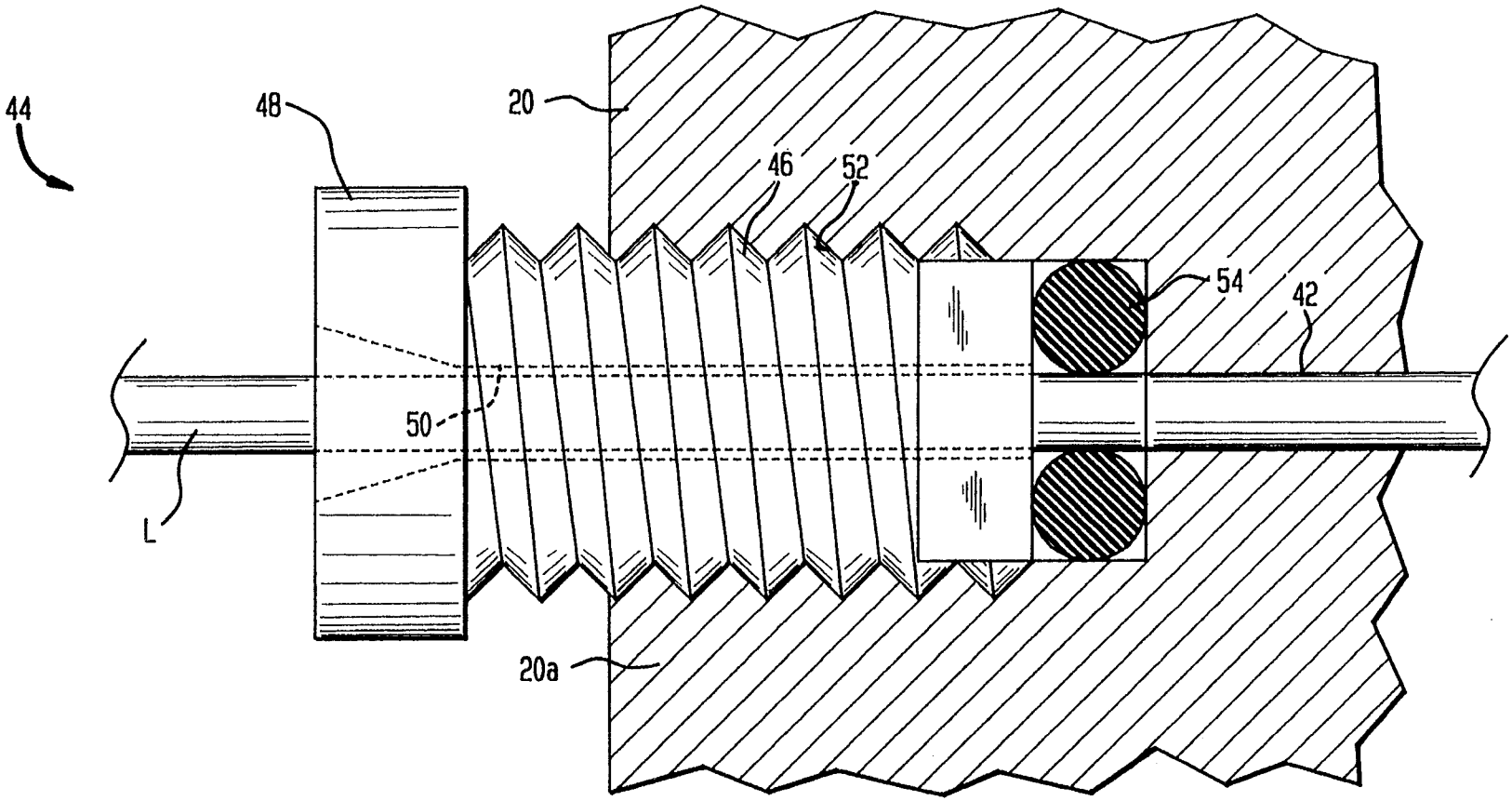
FIG. 4 is a detailed cross-sectional view of a preferred embodiment of a sealing arrangement of the invention.

The line L is trained around the pulley assemblies 28,37 and extends slidably through an axial opening 42 in the piston 20 and a seal 44 mounted in the axial opening at opposite ends thereof. Seal 44 is depicted in detail in FIG. 4 wherein the seal is depicted as having a threaded portion 46 and a compression flange 48 at one end thereof through which an axial through bore 50 extends in coaxial alignment with the axial opening 42 in the piston 20. The threaded portion 46 is threadedly received in a threaded bore 52 formed in one or both end faces 20*a*,20*b* of piston 20 and an O-ring 54 is disposed between the threaded portion 46 and the bottom of the threaded bore 52 for sealing contact with the line L. Similar seals 44 may also be disposed in the end walls 16,24 to prevent leakage of pressurized actuating fluid and to provide a sealed system. Preferably, however, three compression seals 44 will be located at the points where the line n enters the cylinder 18 through walls 16,24, and where the line passes through the piston 20, at end face 20*a*. In the alternative, a simple wiper bushing (not shown) could be installed before the inlet seal in end wall 24 to prevent debris on the line L from entering the winch 10.

Pressurized fluid, such as air, may be supplied from a tank 60 into the working chamber 62 (formed between end wall 16 and piston 20) of cylinder 18, through an ON/OFF valve 64 and an electrically operated three way valve 66 having a cylinder input 68 which is normally open to connect the working chamber 62 to the pressurized air source 60 through the ON/OFF valve 64. Under the action of pressurized air, piston 20 moves in its upward stroke in direction A until it abuts against the mechanical stops 40 at the upper end of the cylinder 18. During this work stroke, as the pulley assemblies 28,37 separate from each other, line L is drawn into the cylinder 18 through brake 22 for a distance equal to twice the length of the piston stroke as measured between the stops 38,40. The amount of line L drawn into cylinder 18 with each upward piston stroke can be multiplied simply by adding a number of pulleys 33 to one or both of the fixed and movable pulley assemblies 28,37.

When piston 20 reaches the end of its upward stroke against the mechanical stops 40, a vent valve 70, mounted to piston 20 to project upwardly from the top end face 20*b* thereof, contacts the upper mechanical stop and, under this action, the spring loaded vent valve opens to allow pressure from the working chamber (lower) 62 to enter the upper chamber 72 through an axial through bore 74 extending in the piston 20 to equilibrate the pressures in the upper and the lower chambers. Air pressure in the upper chamber 72, in excess of a preset value (e.g. 50 psi) will be vented to atmosphere through a relief valve 76.

Figure 2:
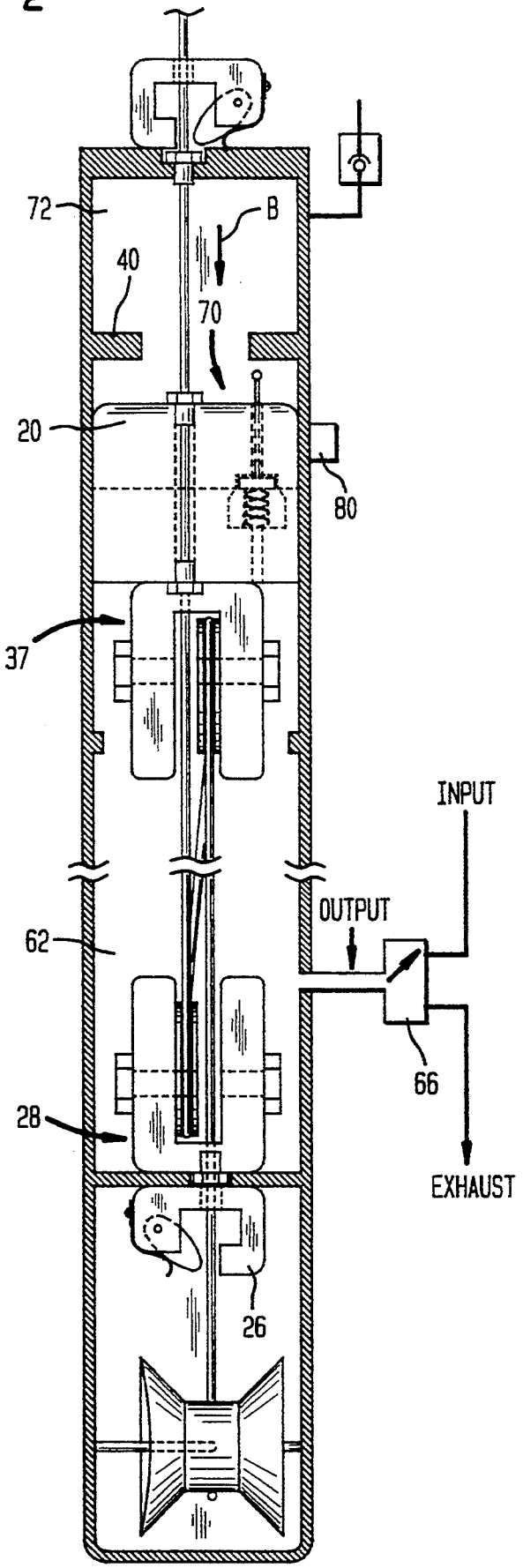
FIG. 2 is a view similar to FIG. 1 depicting the winch at the end of its working stroke.
Figure 3:
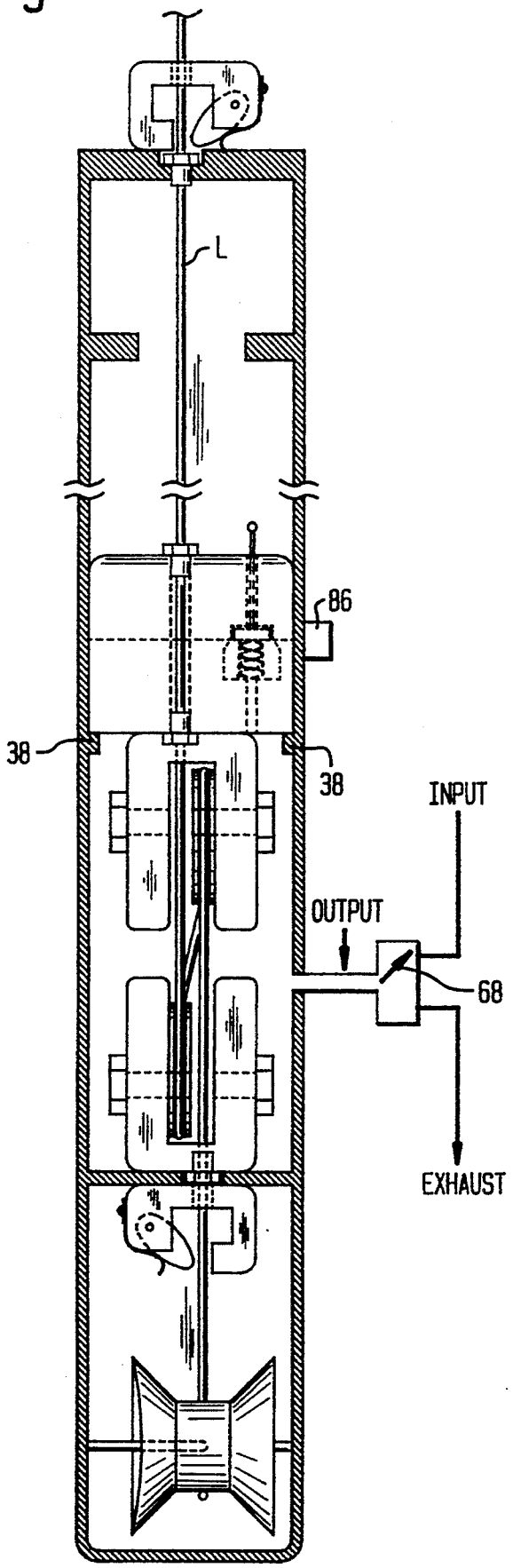
FIG. 3 is a view similar to FIG. 1 depicting the winch at the end of its return stroke.

The upper end-of-stroke position of the piston 20 is sensed by means of a Hall Effect Sensor 80 sensing a ferrous metal ring 82 embedded in the preferably nonferrous piston. This Hall Effect Sensor 80 is electrically connected through 84 to convey a signal to the electrically operated three way valve 66, causing the valve to be placed in its closed or exhaust position, FIG. 2. In this position, the valve 66 will now vent the compressed air in the working chamber 62 to the atmosphere. When the pressure in the working chamber 62 decreases to less than the pressure in the upper chamber 72, the piston 20 will begin to move in its downward stroke in the direction of arrow B. This causes the vent valve 70 to close as the piston 20 moves off of the upper mechanical stops 40. As the piston 20 moves in direction B, the line L looped around the two pulley assemblies 28,37 will exit the cylinder 18 through the lower one way line brake 26 until the piston reaches the lower mechanical stops 38 as it moves from the position depicted in FIG. 2 to that depicted in FIG. 3. The lower Hall Effect Sensor 86 will now sense the ferrous ring 82 embedded in the piston 20 to transmit a signal through 88 to the electrically operated three way valve 66 to cause the valve to be placed into its normally open (input) position as depicted in FIG. 3. The above sequence will now be repeated until the ON/OFF valve 64 is placed in the OFF position.

The feature of locating the pulley assemblies 28,37 within the working or lower chamber 62 of the piston 20 and cylinder 18 results in a pneumatic winch 10 having a smaller volume, less mass and fewer working parts than other pneumatic winches of which we are aware. Further, the smaller number of parts, the fact that the parts are off-the-shelf items (e.g. cylinders, pulleys, pistons, etc.) and the relatively low amount of material in the pneumatic winch greatly reduces the complexity and cost of manufacture as compared to the prior art. This relatively simple design of pneumatic winch 10 will also increase reliability in view of the small number of moving parts, as compared to more complex prior art arrangements.

The feature of locating the pulley arrangement 12 within the working area 62 also results in improved distribution of force and thereby a stronger and safer pneumatic winch device 10 as compared to the prior art. This is because the weakest points in a pressurized closed cylinder 18 are the end walls 16,24. Advantageously, however, due to the internal location of the pulley assemblies 28,37 and the associated line L, an evenly distributed force will be exerted on each end wall 16,24 that is in an opposite direction to the force exerted on the same end wall as a result of internal compression. In other words, during operation the expansion forces on the end walls 16,24 of the pneumatic winch 10, due to pressurization of the cylinder 18 (i.e. the pressure differential across the end wall), will be counterbalanced by the pull exerted by the internal pulley assemblies 28,37 and the line L. This reduction in force on the bottom end wall 16 is what results in a stronger and safer device.

In pneumatic winch 10, the piston area, cylinder length, pulley number, and pulley arrangements can be easily and inexpensively adjusted to meet the needs of a wide variety of winching and hoisting requirements. Further, if desired, hydraulic rather than pneumatic pressurization could be used to power the winch 10. Furthermore, in situations where only a low pressure shop compressor is available as a source of compressed air, a large diameter piston can be used to increase the force exerted on line L.

Pneumatic winch 10 is capable of other types of uses in addition to its preferred use as a vertical winch or lifting device. For example, winch 10 may be used as a horizontal winch to reel in extended lengths of line. This use would require either manual extraction of the line being ejected from end wall 16, or a spring loaded take up reel, in a manner which will now occur to one of ordinary skill in the art from a review of the specification.

Instead of compressed air, a chemical gas generating system, similar to that used to inflate automotive air bags, could be used to provide the driving force for winch 10.

A locking ball (not shown) can also be used near the upper end of line L to trip the ON/OFF valve when the winch 10 (if used as an ascendor lifting itself along a line) reaches the upper end of its travel. To lower the winch 10 when used as an ascender in this manner, simply requires disengaging both the upper and lower one way line brakes 22, 26.

In addition, other pulley configurations of the type disclosed in application Ser. No. 07/789,242, now abandoned, may be used in winch 10 of the present invention, and these other types of configurations are incorporated by reference herein.

The following are examples of power available for a given size of winch 10 constructed in accordance with the principles of the present invention:

| CYLINDER ID (IN) (LBS) | PISTON AREA (SQ IN) | APPLIED PRESS. (PSI) | INITIAL FORCE (LBS) | RETRACTION RATIO | RETRACTION FORCE |
|---|---|---|---|---|---|
| 8 | 50.26 | 5000 | 251328 | 9:1 | 27925 |
| 5 | 26.27 | 5000 | 141350 | 9:1 | 17668 |
| 4 | 12.57 | 5000 | 82850 | 9:1 | 6883 |
| 2 | 3.14 | 3000 | 9000 | 5:1 | 1500 |
| 1 | 0.785 | 2000 | 1571 | 6:1 | 314 |

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

We claim:

1. A winch for operating a line, comprising:

(a) a cylinder and a piston movable within the cylinder, said cylinder and said piston defining a working chamber;

(b) a first pulley assembly fixedly mounted to the cylinder and a second pulley assembly mounted to the piston for movement therewith relative to the first pulley assembly, said first and second pulley assemblies being disposed in said working chamber; said line being alternately wound around said first and second pulley assemblies and extending outside of said cylinder;

(c) a pressurized fluid source for introducing a pressurized fluid into said working chamber and reciprocating said piston within said cylinder;

whereby movement of said piston and said second pulley assembly in a direction away from the first pulley assembly is induced by said pressurized fluid.

2. The winch of claim 1, further comprising:

an ON/OFF switch;

a first brake unit connected to the cylinder and the line for preventing said line from exiting said cylinder therethrough;

a valve movable into an input position for enabling pressurized fluid to enter the cylinder and thereby move said piston in a first stroke, said valve being movable into an exhaust position for enabling pressurized fluid to be exhausted from the cylinder in the return or second stroke of the piston; and a control arrangement for controlling the operation of said valve.

3. The winch of claim 2, wherein said piston control arrangement includes a pair of sensors for sensing piston movement in its end of stroke positions and accordingly operating said valve to alternately charge and vent a working chamber of said cylinder.

4. The winch of claim 3, wherein said sensors are Hall Effect Sensors, and wherein said piston and cylinder are made of non-ferrous material and said piston further includes a ferrous member detectable with said Hall Effect Sensors to enable detection of piston location.

5. The winch of claim 3, further comprising a relief valve communicating with a second chamber in the cylinder formed on the non-working side of the piston.

6. The winch of claim 5, wherein said piston further includes a vent valve for equalizing pressure between the working chamber and said second chamber when the piston reaches the end of its first or working stroke.

7. The winch of claim 6, wherein the end of stroke positions are defined by mechanical stop arrangements at opposite ends of the cylinder, said vent valve being operated by contact with one of said mechanical stop arrangements as said piston reaches the end of its working stroke.

8. The winch of claim 7, further comprising a second brake unit connected to the cylinder and the line for permitting line to exit the cylinder but not enter the cylinder at an exit location different from the entrance location defined by the first brake unit.

9. The winch of claim 7, further comprising a takeup reel for winding line thereon which has entered the cylinder through the first brake unit.

10. The winch of claim 1, further comprising a takeup reel for winding line thereon which has entered the cylinder through the first brake unit.

11. The winch of claim 1, wherein each of said first and second pulley assemblies comprises a pulley mounting bracket and a shaft having opposite ends journaled in said bracket, and pulleys being mounted on said shaft.

12. The winch of claim 11, wherein a plurality of pulleys are mounted on at least one of said first and second pulley assemblies.

13. The winch of claim 1, wherein said first pulley assembly is mounted on an end wall of said cylinder.

14. A winch for operating a line, comprising:

(a) a cylinder and a piston movable within the cylinder, a working chamber in said cylinder being defined by said cylinder and said piston;

(b) a first pulley assembly fixedly mounted to the cylinder and a second pulley assembly mounted to the piston for movement therewith relative to the first pulley assembly; said line being alternately wound around said first and second pulley assemblies and extending outside of said cylinder;

(c) a first brake unit connected to the cylinder and the line for permitting said line to enter said cylinder while preventing said line from exiting said cylinder therethrough;

(d) a second brake unit connected to the cylinder and the line for permitting line to exit the cylinder but not enter the cylinder at an exit location different from the entrance location defined by the first brake unit; and (e) a piston actuating arrangement for reciprocating said piston in said cylinder;

whereby movement of said piston and said second pulley assembly in a first stroke, induced by said piston actuating arrangement in a direction away from the first pulley assembly, causes line to enter said cylinder.

15. The winch of claim 14, wherein said first and second pulley assemblies are located in the working chamber of the cylinder and the first and second brake units are respectively located at opposite ends of the cylinder.

16. The winch of claim 15, further comprising sealing means disposed at the entrance and exit locations and in the piston for effecting sealing sliding contact with the line entering and exiting the cylinder and the piston during movement of the piston.

17. The winch of claim 14, wherein said piston actuating arrangement further comprises;

an ON/OFF switch;

a valve movable into an input position for enabling pressurized fluid to enter the cylinder and thereby move said piston in said first stroke, said valve being movable into an exhaust position for enabling pressurized fluid to be exhausted from the cylinder in the return or second stroke of the piston; and a control arrangement for controlling the operation of said valve.

18. The winch of claim 17, wherein said control arrangement further comprises a pair of sensors for sensing said piston in its end of stroke positions and accordingly operating said valve to alternately charge and vent a working chamber of said cylinder.

19. The winch of claim 18, wherein said sensors are Hall effect sensors, and wherein said piston and cylinder are made of non-ferrous material, and said piston further includes a ferrous member detectable with said Hall effect sensors to enable detection of a piston location.

20. The winch of claim 18, further comprising a relief valve communicating with a second chamber in the cylinder formed on a non-working side of the piston.

21. The winch of claim 20, wherein said piston further includes a vent valve for equalizing pressure between the working chamber and said second chamber when the piston reaches the end of its first stroke.

22. The winch of claim 21, wherein the end of stroke positions are defined by mechanical stop arrangements at opposite ends of the cylinder, said vent valve being operated by contact with one of said mechanical stop arrangements as said piston reaches the end of its first stroke.

23. The winch of claim 22, further comprising a takeup reel for winding line thereon which has entered the cylinder through the first brake unit.

24. A method of winching in a line which is operatively connected to a pair of fixed and movable pulley assemblies disposed in a working chamber defined by a piston and cylinder, comprising the steps of:

moving the piston in a working stroke to progressively separate the first and second pulley assemblies from each other to cause said line to enter said cylinder in accordance with a predetermined pulley ratio; and venting said working chamber to allow the piston to move in its return stroke while preventing line which has entered said cylinder during the working stroke from exiting said cylinder through the entrance area.

25. A winch for operating a line, comprising:

a cylinder and at least one piston movable within the cylinder;

a first pulley assembly mounted within said cylinder and a second pulley assembly mounted to said at least one piston for movement therewith relative to the first pulley assembly; said line being alternately wound around said first and second pulley assemblies and extending outside of said cylinder;

a first brake unit connected to the cylinder and the line for permitting said line to enter said cylinder through said first brake unit, while preventing said line from exiting said cylinder therethrough; and a piston actuating arrangement for reciprocating said at least one piston in said cylinder;

whereby movement of said at least one piston and second pulley assembly in a first stroke induced by said piston actuating arrangement in a direction away from the first pulley assembly causes line to enter said cylinder.

* * * * *